US006874736B1

(12) United States Patent
Jones et al.

(10) Patent No.: US 6,874,736 B1
(45) Date of Patent: Apr. 5, 2005

(54) KEYBOARD SUPPORT

(75) Inventors: David K. Jones, Grand Rapids, MI (US); Joseph D. Ruedinger, Grand Haven, MI (US); Jason E. Begin, Grand Rapids, MI (US)

(73) Assignee: Steelcase Development Corporation, Caledonia, MI (US)

( * ) Notice: Subject to any disclaimer, the term of this patent is extended or adjusted under 35 U.S.C. 154(b) by 468 days.

(21) Appl. No.: 09/627,341

(22) Filed: Jul. 28, 2000

(51) Int. Cl.[7] ..... B68G 5/00; A47H 1/10

(52) U.S. Cl. ..... 248/118; 248/918; 248/298.1

(58) Field of Search ..... 248/118, 346.01, 248/118.3, 393, 298.1, 295.11, 291.1, 292.14, 918

(56) References Cited

U.S. PATENT DOCUMENTS

| | | | | |
|---|---|---|---|---|
| 363,142 | A | | 5/1887 | Horton |
| 560,465 | A | | 5/1896 | Bostwick |
| D33,849 | S | | 1/1901 | Meyer |
| 1,006,334 | A | | 10/1911 | Wright |
| 1,681,586 | A | | 8/1928 | Kessler |
| 1,704,561 | A | | 3/1929 | Egan |
| 1,719,503 | A | | 7/1929 | Egan |
| 1,841,690 | A | | 1/1932 | Weindel, Jr. |
| 2,117,668 | A | | 5/1938 | Johnson |
| D183,947 | S | | 11/1958 | Quistgaard |
| 3,073,056 | A | | 1/1963 | Russell |
| 3,272,183 | A | | 9/1966 | Craighead et al. |
| 3,361,131 | A | | 1/1968 | Barger |
| 3,779,504 | A | | 12/1973 | Schwartz et al. |
| D246,062 | S | | 10/1977 | Kowalski |
| 4,125,243 | A | | 11/1978 | Liptak |
| 4,162,055 | A | * | 7/1979 | Summers ..... 248/441.1 |
| 4,204,598 | A | | 5/1980 | Adams |
| D271,895 | S | | 12/1983 | Runions |
| D272,547 | S | | 2/1984 | Gordon |
| D273,961 | S | | 5/1984 | Bassey |
| D274,919 | S | | 7/1984 | Basaldua, Jr. |
| 4,475,705 | A | | 10/1984 | Henneberg et al. |
| 4,494,755 | A | | 1/1985 | Caillouet, Jr. |
| 4,546,947 | A | | 10/1985 | Gesten |
| D281,384 | S | | 11/1985 | Lacey |
| 4,635,893 | A | | 1/1987 | Nelson |
| 4,645,163 | A | | 2/1987 | Zovar |

(Continued)

FOREIGN PATENT DOCUMENTS

| | | | |
|---|---|---|---|
| WO | WO 94/06631 | * | 3/1994 |

*Primary Examiner*—Anita King
(74) *Attorney, Agent, or Firm*—Price, Heneveld, Cooper, DeWitt & Litton

(57) ABSTRACT

A keyboard support platform including a keyboard support member adapted to support a keyboard and having a front edge adapted to be positioned adjacent a user. The keyboard support member includes first and second opposite side edges defining a width therebetween. A first mouse support surface is movably mounted to the keyboard member and movably positioned adjacent the first side edge to provide adjustment of the first mouse support surface. A second mouse support surface is movably mounted to the keyboard support member and movably positioned adjacent the second side edge of the keyboard support member to provide adjustment of the second mouse support surface. A palm rest is adjustably mounted to the keyboard support member adjacent the front edge and repositionable between a first position wherein at least a portion of the palm rest extends in front of the first mouse support surface, and a second position wherein at least a portion of the palm rest extends in front of the second mouse support surface. The palm rest has a length substantially greater than the width of the keyboard support member such that a portion of the palm rest extends in front of the keyboard support member and at least a selected one of the first and second supports.

28 Claims, 5 Drawing Sheets

U.S. PATENT DOCUMENTS 4,685,647 A 8/1987 Calhoun
D294,209 S 2/1988 Havelka
4,836,489 A 6/1989 Chu
4,840,361 A 6/1989 Richter
D303,126 S 8/1989 Rossow
4,863,124 A 9/1989 Ball et al.
4,893,775 A 1/1990 Long
D306,529 S 3/1990 Goodell
4,976,407 A 12/1990 Schwartz et al.
D314,565 S 2/1991 Davis et al.
D314,566 S 2/1991 Davis et al.
D316,115 S 4/1991 Davis et al.
D320,198 S 9/1991 Ward
5,050,826 A 9/1991 Johnston
5,067,681 A 11/1991 Huang et al.
5,074,511 A 12/1991 Wilson
5,104,086 A 4/1992 Ramey, III et al.
D328,923 S 8/1992 Tu
5,136,787 A 8/1992 Phills
5,144,303 A 9/1992 Purcell
5,144,763 A 9/1992 Calhoun
5,161,767 A 11/1992 Hansen
5,183,230 A 2/1993 Walker et al.
D333,723 S 3/1993 Risner
D333,819 S 3/1993 Toney
5,264,995 A 11/1993 McKee
5,292,099 A 3/1994 Isham et al.
5,301,915 A 4/1994 Bahniuk et al.
D348,374 S 7/1994 Dandurand
5,328,145 A 7/1994 Charapich
5,341,929 A 8/1994 Stefancin, Jr.
5,342,006 A * 8/1994 Tice ..... 248/118
D350,374 S 9/1994 Comeau
5,347,738 A 9/1994 Zweig et al.
5,383,643 A 1/1995 Koch
5,386,956 A 2/1995 Hatcher
5,398,905 A 3/1995 Hinson
D357,008 S 4/1995 Pohlman
D357,705 S 4/1995 Milojevich
5,433,407 A 7/1995 Rice
5,443,237 A 8/1995 Stadtmauer
D366,064 S 1/1996 Milojevich
D366,675 S 1/1996 Milojevich
5,497,970 A 3/1996 Pursell, Jr.
5,499,793 A 3/1996 Salansky
5,505,421 A 4/1996 Marthaler
D369,473 S 5/1996 Gluck
5,513,824 A 5/1996 Leavitt et al.
5,533,702 A 7/1996 Koch
5,556,061 A 9/1996 Dickie
5,593,128 A 1/1997 Odom et al.
5,618,020 A 4/1997 Hegarty et al.
D379,374 S 5/1997 Mason, III
5,636,822 A 6/1997 Hendershot et al.
5,651,524 A 7/1997 Calfee
D382,017 S 8/1997 Bohr et al.
5,661,633 A 8/1997 Patret
D383,122 S 9/1997 Parks
5,678,792 A 10/1997 Arguin et al.
D386,532 S 11/1997 Bass
D387,744 S * 12/1997 Kirchhoff et al. ..... D14/114
5,723,821 A 3/1998 Klinger et al.
5,730,408 A * 3/1998 McAllister et al. .... 248/288.51
5,732,910 A * 3/1998 Martin ..... 248/118
5,735,222 A 4/1998 Webb
5,750,934 A 5/1998 Kuljis
D395,554 S 6/1998 Perkins, Jr.
D396,309 S 7/1998 Churchville et al.
5,775,663 A 7/1998 Fitzsimmons et al.
5,786,861 A 7/1998 Parker
5,806,693 A 9/1998 Carbonaro
5,844,775 A 12/1998 Lundberg
5,857,654 A 1/1999 Berman
5,890,603 A 4/1999 Arguin et al.
5,901,934 A * 5/1999 Wilson ..... 248/346.01
5,901,937 A 5/1999 Compeau et al.
5,927,662 A 7/1999 West et al.
6,003,446 A 12/1999 Leibowitz
6,045,098 A * 4/2000 Timm ..... 248/118
6,079,676 A 6/2000 Hackett et al.

* cited by examiner

KEYBOARD SUPPORT

BACKGROUND OF THE INVENTION

Personal computers have become more common in many industry and office environments. Such systems may employ a keypad, mouse, and/or other data input devices, such as a digitizing pad. Often, the personal computer occupies much of the desk or worksurface, making it difficult to locate the keyboard thereon. Furthermore, many users do not prefer to locate the keyboard on the desktop because it is uncomfortable to address the keyboard over the course of the work day.

A number of devices have been developed to offer greater flexibility in supporting the keyboard, mouse, or other user interface devices at a comfortable position relative to the user. Many of these systems are structurally complex and typically require rather awkward adjustments through manipulations of a number of knobs and levers or handles. Moreover, many of the adjustable keyboard supports available today utilize an adjustment system which is counter-intuitive, such that the user must learn a detailed sequence of steps, knobs, locks, etc. before the device can be used effectively instead of simply moving the keyboard directly to the desired position.

Available keyboard support assemblies may include a keyboard support surface that is permanently attached to a height adjustment device such as an articulating support arm. Various keyboard support configurations have been developed and may include a hand support, a mouse support, or a specific keyboard clamping arrangement. Conventional keyboard supports may not provide adequate positioning of the keyboard itself, or the palm rest. Furthermore, management of the mouse cable may be problematic, leading to the mouse falling off the mouse support surface. Also, placement of a document in a position that is readable by the keyboard user may be difficult given the limited space that is typically available on the worksurface.

SUMMARY OF THE INVENTION

One aspect of the present invention is a keyboard support platform including a keyboard support member adapted to support a keyboard and having a front edge adapted to be positioned adjacent a user. The keyboard support member includes first and second opposite side edges defining a width therebetween. A first mouse support surface is movably mounted to the keyboard member adjacent the first side edge to provide adjustment of the first mouse support surface. A second mouse support surface is movably mounted to the keyboard support member adjacent the second side edge of the keyboard support member to provide adjustment of the second mouse support surface. A palm rest is adjustably mounted, to the keyboard support member adjacent the front edge and repositionable between a first position wherein at least a portion of the palm rest extends in front of the first mouse support surface, and a second position wherein at least a portion of the palm rest extends in front of the second mouse support surface. The palm rest has a length substantially greater than the width of the keyboard support member such that a portion of the palm rest extends in front of the keyboard support member and at least a selected one of the first and second supports.

Another aspect of the present invention is a keyboard support including a keyboard support member configured to support a keyboard. A mouse support surface is positioned adjacent the keyboard support member, and a cable manager is positioned adjacent the mouse support surface. The cable manager includes a movable retainer capable of gripping an associated mouse cable. The cable manager further includes a pass-through opening permitting a mouse cable to slide therethrough, such that a mouse cable can be selectively gripped to prevent movement or slidably guided through the pass-through opening.

Yet another aspect of the present invention is a keyboard support platform including a mounting member adapted to be secured to an associated worksurface. A keyboard support member is adapted to support a keyboard. The keyboard support member is slidably supported by the mounting member to permit side-to-side movement of the keyboard support member relative to the mounting member. The mounting member includes a document support configured to support a document in a generally upright position wherein the document is visible to a user.

These and other features, advantages, and objects of the present invention will be further understood and appreciated by those skilled in the art by reference to the following specification, claims, and appended drawings.

BRIEF DESCRIPTION OF THE DRAWINGS

FIG. 5;

DETAILED DESCRIPTION OF PREFERRED EMBODIMENT

Figure 1:
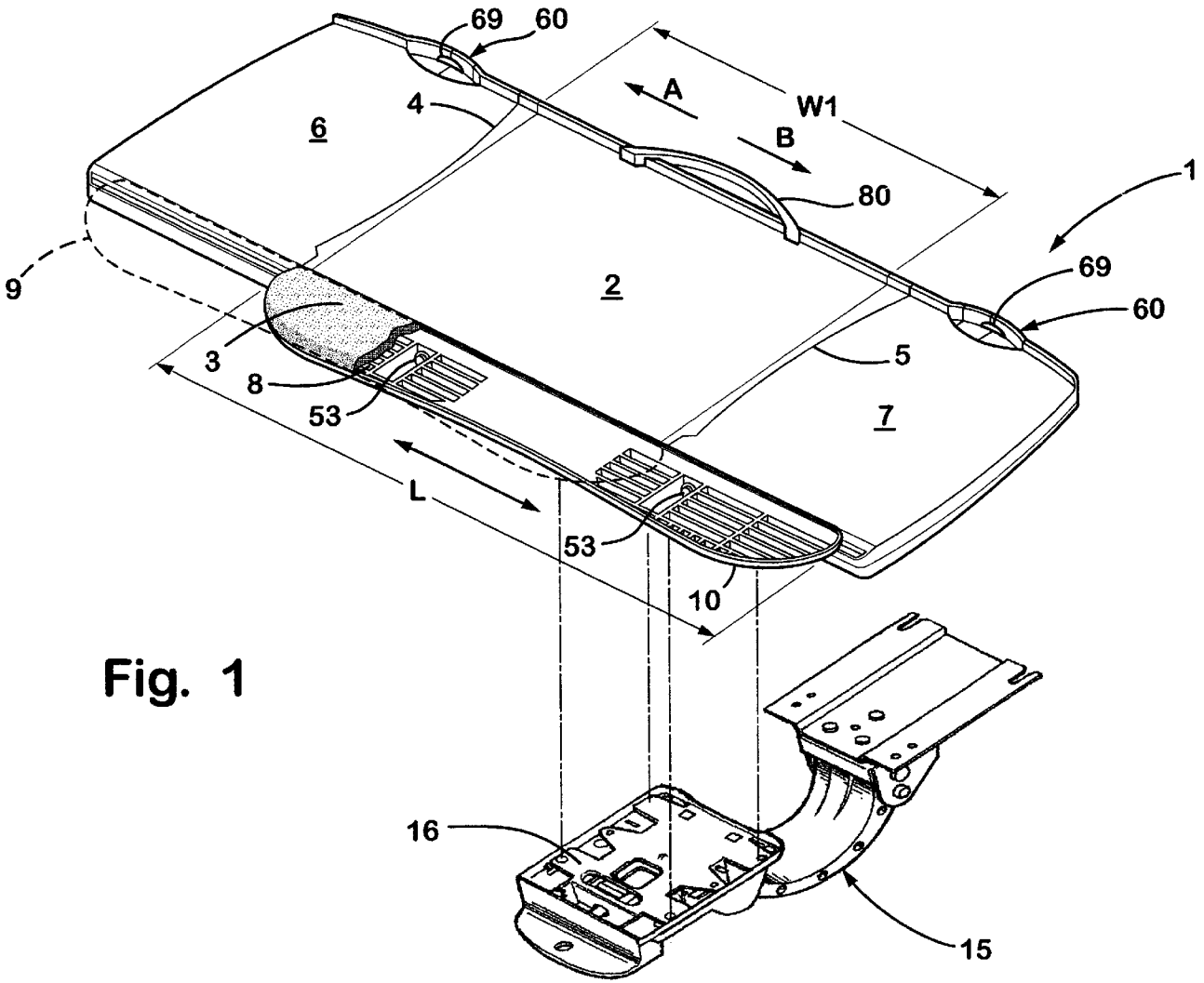
FIG. 1 is a partially exploded, perspective view of the keyboard support platform of the resent invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The reference numeral 1 (FIG. 1) generally designates a keyboard support platform embodying the present invention, which is particularly designed for use in offices, and other similar settings and environments. In the illustrated example, keyboard support platform 1 includes a keyboard support member 2 adapted to support a keyboard and having a front edge 3 adapted to be positioned adjacent a user. The keyboard support member has first and second opposite side edges 4, 5 defining a width "W1" therebetween. A first mouse support surface 6 is movably mounted to the keyboard support member 2 adjacent the first side edge 4 to provide adjustment of the first mouse support surface 6. A second mouse support surface 7 is movably mounted to the keyboard support member 2 adjacent the second side edge 5 to provide adjustment of the second mouse support surface 7. A palm rest 8 is adjustably mounted to the keyboard support member 2 adjacent the front edge 3 thereof. The palm rest is repositionable between a first position wherein at least a portion 9 of the palm rest 8 extends in front of the first mouse support surface 6, and a second position wherein at least a portion 10 of the palm rest 8 extends in front of the second mouse support surface 7. The palm rest 8 has a length "L" that is substantially greater than the width "W1" of the keyboard support member 2, such that a portion of the palm rest 8 extends in front of the keyboard support member 2 and at least a selected one of the first and second mouse supports 6, 7.

The keyboard support platform 1 of the present invention may be mounted on a variety of articulating supports to adjustably position the keyboard support platform adjacent an associated worksurface. An example of one such arm is an existing Steelcase "STELLA" support arm 15 that includes a quick connect/disconnect assembly 16 that permits rapid attachment and/or detachment of keyboard support platform 1 on the articulating arm without the use of tools. The quick connect/disconnect assembly 16 is described in detail in U.S. patent application Ser. No. 09/004,985 filed Jan. 9, 1998, entitled TILT LOCKOUT FOR ARTICULATED KEYBOARD SUPPORTS, now issued U.S. Pat. No. 6,135,405, the entire contents of which are hereby incorporated herein by reference. Mounting plate 18 (FIGS. 2, 3) includes four quick connect studs 17 that engage the quick connect assembly 16 to the articulating arm 15. The quick connect assembly 16 and corresponding studs 17 are described in detail in the above-referenced U.S. Pat. No. 6,135,405, such that these features will not be described in detail herein. Although keyboard support platform 1 is illustrated as being mounted to a standard Steelcase STELLA arm 15, keyboard support platform 1 may also be mounted on a variety of other existing support arms (not shown) with or without quick connect assembly 16.

Figure 2:
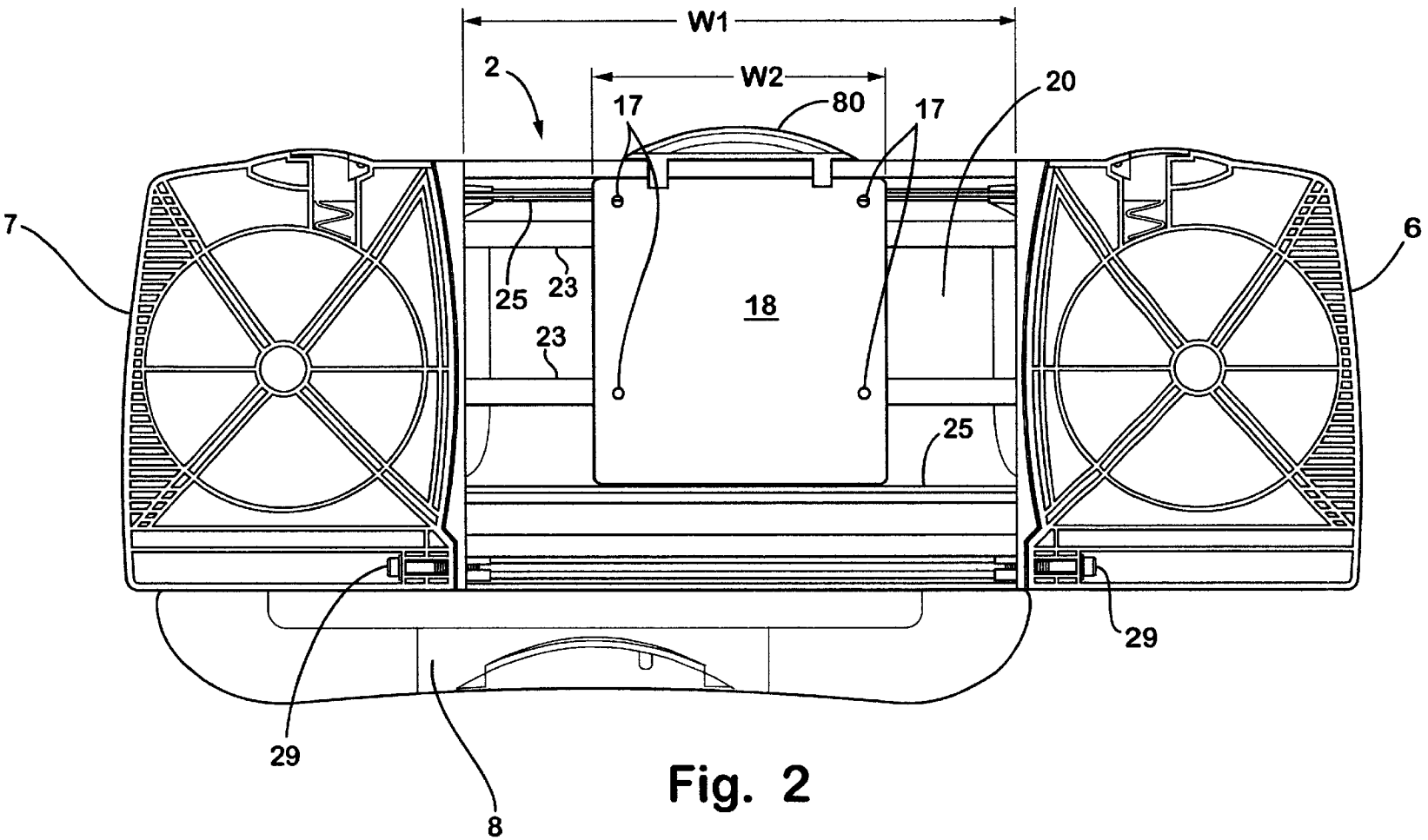
FIG. 2 is a bottom plan view of the keyboard support platform of FIG. 1.
Figures 3, 4:
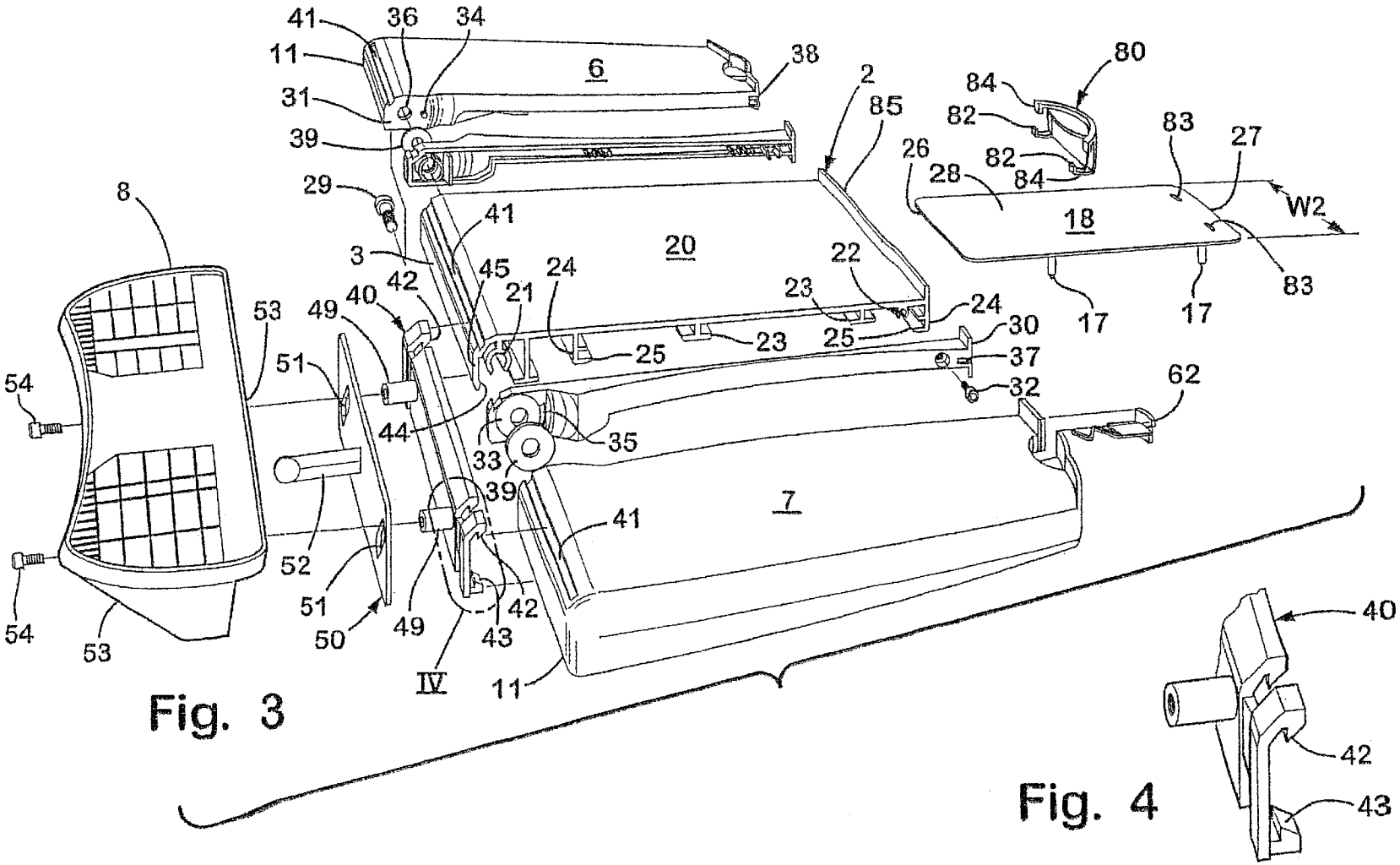
FIG. 3 is an exploded, perspective view of the keyboard support platform of FIG. 1.
FIG. 4 is an enlarged portion of the palm rest support of FIG. 3.

With reference to FIGS. 2 and 3, keyboard support member 2 includes an extrusion 20 having first and second screw bosses 21 and 22. Extrusion 20 includes a pair of elongated "T" shaped pads 23, and a pair of downwardly extending extensions 24. Each of the extensions 24 includes a sidewardly-opening U-shaped channel 25. The front and rear edges 26 and 27, respectively, of mounting plate 18 are slidably received in the U-channels 25. The mounting plate 18 has a width "W2" that is substantially less than the width "W1" of keyboard support member 2 and extrusion 20, such that the keyboard support member 2 can be shifted side-to-side on the mounting plate 18 (and support arm 15). The upper surface 28 of mounting plate 18 abuts the pads 23 to provide support and prevent binding of the extrusion 20 and mounting plate 18. Although other suitable materials may be utilized, extrusion 20 is preferably made of aluminum, and mounting plate 18 is preferably made of steel.

Mouse support surfaces 6 and 7 are pivotally mounted to the extrusion 20 by screws 29 that are threadably received in the first screw boss 21. End caps 30 are secured to the extrusion 20 by a threaded fastener 32 that is received in screw boss 22. End caps 30 include a bearing surface 33 that slidably engages nylon washer 39 that abuts the bearing surface 31 of mouse support pads 6 and 7. A protrusion 34 extends outwardly from bearing surface 31, and is received within an arcuate slot 35 directly adjacent bearing surface 33. The ends of the arcuate slot 35 act as stops when contacted by protrusion 34 to limit the tilt range of motion of the mouse supports 6 and 7 about pivot 36 formed by screws 29. Small protrusions 37 adjacent the opposite ends of end caps 30 engage small indentations 38 in mouse support surfaces 6 and 7 to provide a detent when the mouse support surfaces 6 and 7 are coplanar with the upper surface of the keyboard support member 2.

Extrusion 20 includes an upwardly-opening groove 41 extending along the front edge 3 of the keyboard support member 2. Similarly, the first and second mouse supports 6 and 7 also have a groove 41 extending along front edges 11 of the mouse supports 6 and 7. Palm rest support member 40 includes a downwardly extending hook-like portion 42 (see also FIG. 4) that engages the grooves 41 and permits side-to-side sliding of the palm rest 8. Also, a barb-like extension 43 snaps over the lower edge 44 of downwardly extending extension 45 of extrusion 20 to prevent inadvertent dislodgment of the palm rest 8. The palm rest 8 can be shifted side-to-side and positioned in front of the keyboard support member 2, as well as either the first mouse support 6, or the second mouse support 7. Due to the engagement of the support member 40 with the front edge 11 of mouse supports 6 and/or 7, rotation of the mouse support 6 and/or 7 is prevented when the palm rest 8 is positioned in front of the mouse support 6 and/or 7. This arrangement permits the mouse surfaces 6 and 7 to act as a keyboard support surface. For example, when the wrist rest 8 is shifted to the position illustrated in FIG. 1, a keyboard may be positioned on both the keyboard support member 2, and on the second mouse support surface 7. The mouse support surface 6 may then be used to support the mouse for left-handed use. Alternately, the wrist rest 8 may be shifted in front of the first mouse support 6, and the computer keyboard may then be positioned on both the keyboard support member 2 and the mouse support 6 with right-hand use of a mouse on mouse support 7.

With reference to FIG. 3, support member 40 includes a pair of generally cylindrical bosses 49 that extend through angled slots 51 of slide member 50 when assembled. Palm rest 8 includes a pair of vertical slots 53 (see also FIG. 1). A pair of bolts 54: extend through the vertical slots 53, and through the angled slots 51 in slide member 50, and threadably engage the bosses 49 of support member 40. To adjust the height of the palm rest 8, a user grasps handle 52 of slide member 50, and shifts the slide member 50 horizontally. The engagement of the bosses 49 in the angled slots 51 causes the slide member to shift vertically and sidewardly, thus raising or lowering the palm rest 8.

Figure 5:
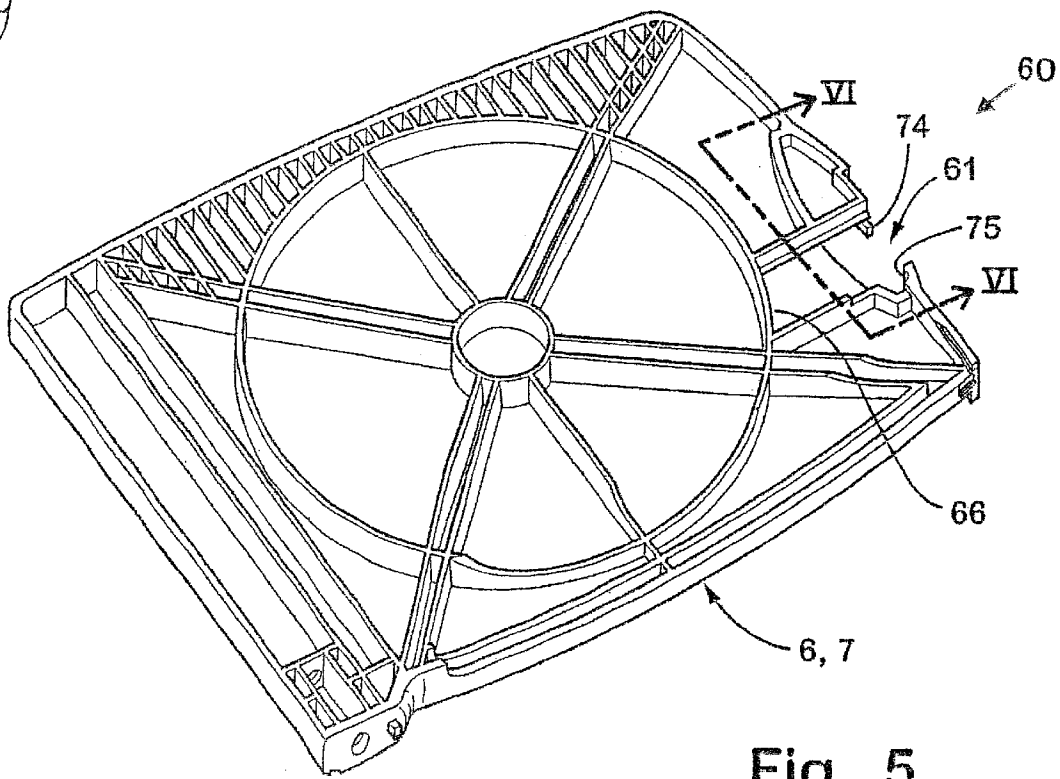
FIG. 5 is a perspective view of the mouse support surfaces of FIG. 1 showing the lower side of the mouse support surface.
Figure 6:
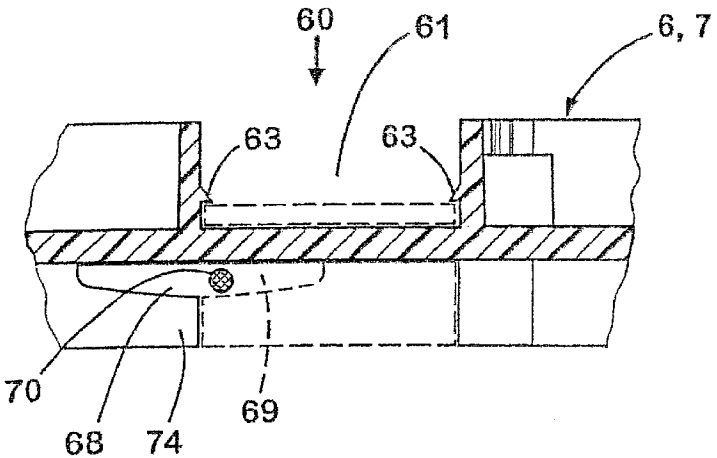
FIG. 6 is a cross-sectional view taken along the line VI—VI.
Figure 7:
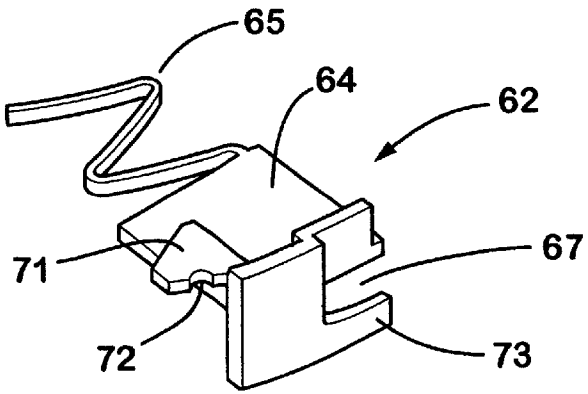
FIG. 7 is a perspective view of the retainer of the mouse cable manager.

With further reference to FIGS. 5 and 6, each of the mouse supports 6 and 7 include a channel 61 that slidably receives a cable-retaining member 62 to form cable managers 60 to retain the cable 70 of an associated computer mouse or keyboard. Retainer 62 includes a flat base portion 64 that is retained in channel 61 by elongated extensions 63. Retainer 62 includes a spring 65 (see also FIG. 7) that abuts surface 66 of mouse pad 6 or 7 to bias the retainer outwardly. When installed, the open portion 67 of retainer 62 is aligned with the open portion 68 of mouse pad 6 or 7 to form a relatively large pass-through opening 69. The pass-through opening 69 is large enough to permit the mouse or keyboard cable 70 to freely slide therethrough. Retainer 62 can be manually shifted inwardly against the bias of spring 65 such that extension 73 of retainer 62 is shifted away from extension 74 of the mouse support 6 or 7. The mouse or keyboard cable 70 can then be placed in the pass-through opening 69, and the retainer 62 is allowed to shift back to the position illustrated in FIGS. 1 and 2. Retainer 62 also includes a clamp portion 71 that can be utilized to clamp against a mouse cable 70. Retainer 62 can be manually shifted inwardly, and the mouse cable 70 placed against the indentation 72 of clamp portion 71 of retainer 62. Retainer 62 is then released, and shifted outwardly by spring 65, such that the mouse or keyboard cable 70 is clamped against the sidewall surface 75 of the mouse pad 6 or 7.

Figure 8:
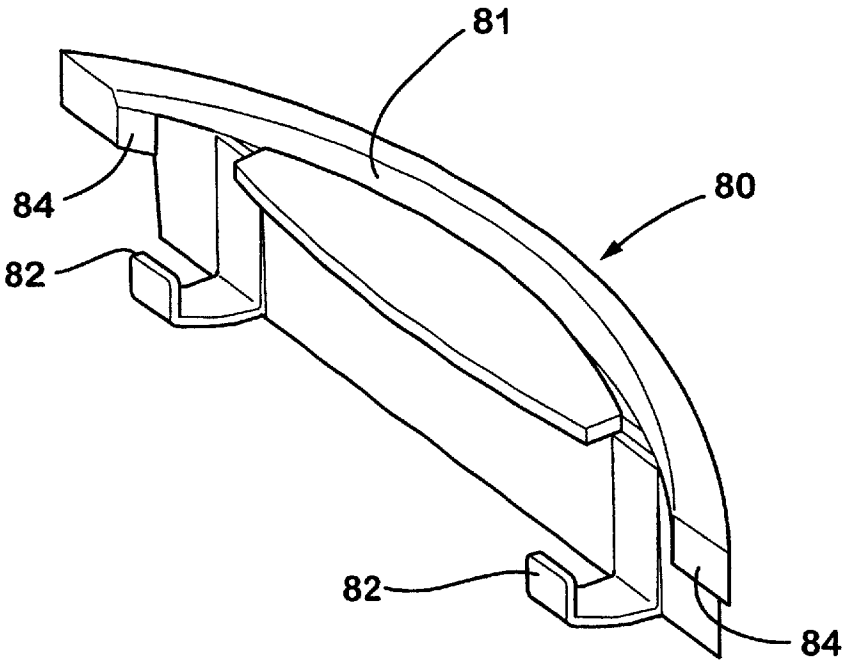
FIG. 8 is a perspective view of the document support of FIG. 1.

With further reference to FIG. 8, a document support 80 includes an upwardly-opening curved groove 81 that may be utilized to support a document in a generally upright position. Groove 81 may have a configuration such as that disclosed in U.S. patent application Ser. No. 09/563,089 (unofficial), filed on May 2, 2000, entitled INTEGRATED KEYBOARD PLATFORM AND DOCUMENT SUPPORT, and U.S. patent application Ser. No. 09/563,093 (unofficial), filed on May 2, 2000, entitled DOCUMENT SUPPORT, the entire contents of each of which are hereby incorporated herein by reference. Document support 80 includes a pair of upwardly extending tabs 82 that are received within slots 83 (see also FIG. 3) of mounting plate 18. A pair of downwardly extending retainers 84 simultaneously engage the upwardly extending rear wall 85 of extrusion 20 to thereby retain the document'support 80 on the keyboard support platform. Because the document support 80 is mounted to the mounting plate 18, the document support 80 slidably moves side-to-side with the plate 18 relative to the keyboard support member 2. Thus, when a computer keyboard is positioned to one side, the keyboard support platform can be shifted on the mounting plate 18, such that the document support 80 is positioned behind the center of the computer keyboard. For example, with reference to FIG. 1, the keyboard support member 2 may be shifted in the direction of the arrow "A", thereby causing the document support 80 to shift oppositely relative to the document support 2, in the direction of the arrow "B".

The keyboard support platform 1 of the present invention provides both left-hand and right-hand mouse support surfaces 6 and 7, each of which rotates to provide tilt adjustment. Furthermore, the mouse supports 6 and 7 can also be utilized to provide support for a computer keyboard when the wrist rest is shifted to a position in front of the keyboard support member 2 and one of the mouse support surfaces 6 or 7. The mouse cable manager 60 provides both a pass-through opening for slidably retaining a mouse or a keyboard cable, as well as a clamping arrangement to securely retain a mouse cable. The document support 80 positions a document directly in front of a user, and can be shifted side-to-side to provide the desired document positioning.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. A keyboard support platform, comprising:

a keyboard support member adapted to support a keyboard and having a front edge adapted to be positioned adjacent a user, and first and second opposite side edges defining a width therebetween;

a first mouse support surface movably mounted to said keyboard support member adjacent said first side edge to provide adjustment of said first mouse support surface;

a second mouse support surface movably mounted to said keyboard support member adjacent said second side edge to provide adjustment of said second mouse support surface; and a palm rest adjustably mounted to said keyboard support member adjacent said front edge and repositionable between a first position wherein at least a portion of said palm rest extends in front of said first mouse support surface, and a second position wherein at least a portion of said palm rest extends in front of said second mouse support surface, said palm rest having a length substantially greater than said width of said keyboard support member such that a portion of said palm rest extends in front of said keyboard support member and at least a selected one of said first and second mouse supports.

2. The keyboard support platform set forth in claim 1, wherein:

said first and second mouse support surfaces are pivotably mounted to said keyboard support member to provide tilt adjustment of said first and second mouse support surfaces.

3. The keyboard support platform set forth in claim 2, wherein:

said first and second mouse support surfaces each include a detent that engages said keyboard support member when said first and second mouse support surfaces are generally coplanar with said keyboard support member.

4. The keyboard support platform set forth in claim 1, wherein:

said first and second mouse support surfaces each define a front edge;

said keyboard support member and said first and second mouse support surfaces each include a groove extending along said front edges; and said palm rest including a support engaging at least a selected one of said grooves and supporting said palm rest in a manner permitting side-to-side movement of said palm rest.

5. The keyboard support platform set forth in claim 4, wherein:

said keyboard support member and said first and second mouse support surfaces each define a retaining edge extending parallel to said groove; and said support having a pair of extensions forming a C-shape, a first extension engaging at least a selected one of said grooves and a second extension extending around at least a selected one of said retaining edges to support and retain said palm rest.

6. The keyboard support platform set forth in claim 1, including:

a mounting member; and wherein:

said keyboard support member is slidably mounted on-said mounting member for side-to-side adjustment of said keyboard support member.

7. The keyboard support platform set forth in claim 6, including:

a document support on said mounting member configured to support documents in a generally upright position.

8. The keyboard support platform set forth in claim 1, wherein:

at least a selected one of said first and second mouse support surfaces includes a mouse cable manager having a movable member biased into a clamped position wherein said cable manager grips and retains an associated mouse cable.

9. The keyboard support platform set forth in claim 8, wherein:

said mouse cable manager includes a pass-through opening having sufficient size to permit a mouse or keyboard cable to slidably pass therethrough.

10. A keyboard support, comprising:

a keyboard support member configured to support a keyboard;

a mouse support surface adjacent said keyboard support member, said mouse support surface defining a side edge;

a cable manager positioned adjacent said mouse support surface, said cable manager including a movable retainer capable of gripping a mouse cable, said cable manager further including a pass-through opening adjacent said side edge permitting the mouse cable to freely slide therethrough, such that the mouse cable can be selectively gripped to prevent movement or slidably guided through the pass-through opening.

11. The keyboard support set forth in claim 10, wherein:

said cable manager includes a spring biasing said movable retainer into a position wherein said retainer grips an associated mouse cable.

12. The keyboard support set forth in claim 10, including:

a mounting member; and wherein:

said keyboard support member is slidably mounted on said mounting member for side-to-side adjustment of said keyboard support member.

13. The keyboard support set forth in claim 12, including:

a document support on said mounting member configured to support documents in a generally upright position.

14. The keyboard support set forth in claim 10, wherein:

said mouse support surface is rotatably mounted to said keyboard support member to provide tilt adjustment of said mouse support surface.

15. The keyboard support set forth in claim 14, wherein:

said keyboard support member and said mouse support surface each have a front edge adapted to be positioned adjacent a user; and including:

a palm rest extending along each said front edge.

16. The keyboard support set forth in claim 15, wherein:

said keyboard support member defines first and second side edges;

said mouse support comprises a first mouse support rotatably mounted along said first side edge; and including:

a second mouse support defining a front edge and rotatably mounted along said second side edge;

said palm rest slidably mounted to said keyboard support member for side-to-side movement.

17. The keyboard support set forth in claim 16, including:

a mounting member; and wherein:

said keyboard support member is slidably mounted on said mounting member for side-to-side adjustment of said keyboard support member.

18. The keyboard support set forth in claim 17, including:

a document support on said mounting member configured to support documents in a generally upright position.

19. The keyboard support set forth in claim 10, wherein:

said mouse support comprises a first mouse support surface; and including:

a second mouse support surface; and wherein:

said first and second mouse support surfaces each include a detent that engages said keyboard support member when said first and second mouse support surfaces are generally coplanar with said keyboard support member.

20. A keyboard support platform, comprising:

a mounting member adapted to be secured to an associated worksurface;

a keyboard support member adapted to support a keyboard;

said keyboard support member slidably supported by said mounting member to permit side-to-side movement of said keyboard support member relative to said mounting member; and wherein:

said mounting member includes a document support configured to support a document in a generally upright position wherein the document is visible to a user said keyboard support member defines opposite side edges; and including:

first and second mouse support surfaces pivotably mounted to said opposite side edges; and wherein:

said keyboard support member and said first and second mouse support surfaces each define front edges; and including:

a palm rest slidably mounted to said keyboard support member for side-to-side movement whereby said palm rest can be selectively positioned along each said front edge.

21. The keyboard support platform set forth in claim 20, wherein:

said document support defines an upwardly-opening groove having a curved shape in plan view.

22. A keyboard support, comprising:

a keyboard support member configured to support a keyboard;

a mouse support surface adjacent said keyboard support member;

a cable manager positioned adjacent said mouse support surface, said cable manager including a movable retainer capable of gripping a mouse cable, said cable manager further including a pass-through opening alongside said movable retainer, said pass-through opening permitting the mouse cable to freely slide therethrough, such that the mouse cable can be selectively gripped to prevent movement or slidably guided through the pass-through opening.

23. A keyboard support platform, comprising:

a mounting member adapted to be secured to an associated worksurface;

a keyboard support member adapted to support a keyboard;

said keyboard support member slidably supported by said mounting member to permit side-to-side movement of said keyboard support member relative to said mounting member; and a document support configured to support a document in a generally upright position wherein the document is visible to a user, said document support adjustable side-to-side relative to said keyboard support member.

24. The keyboard support platform set forth in claim 23, wherein:

said keyboard support member defines opposite side edges; and including:

first and second mouse support surfaces pivotably mounted to said opposite side edges.

25. The keyboard support platform set forth in claim 23, wherein:

said document support is connected to said mounting member such that said document support does not move relative to said mounting member.

26. The keyboard support platform set forth in claim 25, wherein:

said keyboard support member defines a rear edge and includes an upwardly extending wall along said rear edge; and said document holder includes at least one retainer extending downwardly in front of said wall.

27. The keyboard support platform set forth in claim 26, wherein:

said mounting member includes at least one slot; and said document support includes at least one tab received in said slot.

28. The keyboard support platform set forth in claim 23, wherein:

said document support includes an upwardly opening groove having a curved shape in plan view, said groove configured to support a sheet of paper in a generally upright position.

* * * * *